US006486759B2

(12) United States Patent
Haugh et al.

(10) Patent No.: US 6,486,759 B2
(45) Date of Patent: Nov. 26, 2002

(54) CIRCUIT BREAKER CALIBRATION SCREW

(75) Inventors: Tony Hui Haugh, West Hartford, CT (US); Jaymin Sharad Patel, Plantsville, CT (US); Joseph Criniti, New Britain, CT (US); Javier Ignacio Larranaga, Bristol, CT (US); Pedro Acevedo, Hormigueros, PR (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/725,536

(22) Filed: Nov. 29, 2000

(65) Prior Publication Data

US 2002/0063614 A1 May 30, 2002

(51) Int. Cl.[7] ..... H01H 81/02

(52) U.S. Cl. ..... 335/38; 335/35; 335/45; 335/176

(58) Field of Search ..... 335/23–25, 35, 335/92; 337/45, 176, 57, 82, 94, 129, 323, 343, 360, 392

(56) References Cited

U.S. PATENT DOCUMENTS

| | | | | |
|---|---|---|---|---|
| 3,464,040 A | | 8/1969 | Powell | |
| 4,326,183 A | | 4/1982 | Tharp | |
| 4,513,268 A | | 4/1985 | Seymour et al. | |
| 5,221,234 A | * | 6/1993 | Pakos | 470/10 |
| 5,775,850 A | * | 7/1998 | Gale et al. | 285/355 |
| 5,886,600 A | * | 3/1999 | Larranage et al. | 335/35 |

FOREIGN PATENT DOCUMENTS

| | | |
|---|---|---|
| CA | 962309 | 2/1975 |
| EP | 175976 | 4/1986 |
| GB | 2004699 | 4/1979 |

* cited by examiner

*Primary Examiner*—Lincoln Donovan
(74) *Attorney, Agent, or Firm*—Karl A. Vick

(57) ABSTRACT

A molded case circuit breaker that includes a double headed calibration screw. The calibration screw has a first and second end with identical convex tip surfaces and screw driver engagement surfaces. The convex tip surface is suitable for engaging a bi-metal thermal overload element. The screw driver engagement surface is suitable for applying a screw driver to adjust the calibration screw position in order to adjust the deflection of the bimetal and calibrate the thermal overload protection. At least one calibration screw planar surface allows for improved sealant injection to permanently fix the screw position and associated calibration setting following adjustment.

16 Claims, 3 Drawing Sheets

CIRCUIT BREAKER CALIBRATION SCREW

TECHNICAL FIELD

The invention relates generally to circuit breakers and, in particular, to circuit breakers having an improved calibration screw. The invention further relates to an improved method for calibrating a circuit breaker bi-metal to a permanent setting.

BACKGROUND OF THE INVENTION

Molded case circuit breakers provide overcurrent protection for residential, and some commercial and industrial electrical circuits. These circuit breakers are generally installed in lighting or distribution load centers to supply electrical load at lower voltages and currents. A 20 Amp circuit that supplies 120 V electrical outlets in a residence is one example. The molded case circuit breaker is typically installed in a distribution load center with other like breakers. Lighting circuit installations are also characterized by the installation of multiple molded case breakers in a single load center. A load center consists of a sheet metal enclosure with a hinged door that allows access to the face of the enclosed molded case circuit breakers. The circuit breakers are secured within an inner sheet metal panel. Electrical busses and conductor raceways are located beneath this inner panel. The molded case breakers generally include a molded case main breaker supplying at least one common bus located within the load center. Multiple molded case circuit breakers are then used to distribute power to external electrical load. These "distribution breakers" are connected to both the common bus and external circuits that supply the electrical load. The distribution breaker line stab is connected to the common bus and the external electrical circuit is connected to a circuit breaker terminal lug. Generally, each distribution breaker supplies a single electrical circuit that may supply multiple remote electrical loads.

Molded case breakers are generally inexpensive and non-serviceable pieces of equipment. Therefore, manufacturers have attempted to design these circuit breakers for low cost assembly. U.S. Pat. No. 3,464,040 entitled "Compact Circuit Breaker Construction", herein incorporated by reference, discloses a one-half inch residential molded case circuit breaker designed for economical fabrication on mass production equipment. Manufacturers next turned to robotic assembly. U.S. Pat. No. 4,513,268 entitled "Automated Q-Line Circuit Breaker", herein incorporated by reference, discloses a molded case circuit breaker designed for completely automated assembly and calibration.

Molded case breakers usually include a thermal element in the form of a bi-metal that initiates a circuit breaker trip for low overcurrent conditions. Most molded case also include a magnet and armature that combine to initiate a circuit breaker trip for higher magnitude overcurrents. The assembly taught in the aforementioned U.S. Pat. No. 4,513,268 includes a calibration screw assembly used to adjust the bi-metal and calibrate the overcurrent protection. The calibration screw assembly uses a calibration screw with two opposing ends. A first end having a head and a second end having a tip. The head and the tip are each designed to perform a single specialized function that cannot be performed by the other. Therefore, the shape of the head differs from the shape of the tip. The head is shaped to allow a screwdriver to cooperatively engage the head and apply rotational force to drive the screw in or out of a threaded receptacle. The opposing tip has a flat tip that engages the circuit breaker bi-metal. The bi-metal deflects as the calibration screw is screwed into a threaded receptacle, adjusting the pivot point of the bi-metal as the screw penetration is increased. The tripping current level is adjusted when the bi-metal deflects. The circuit breaker calibration is fixed when sealant or epoxy is applied to the head of the screw to lock it in place after the desired calibration is established.

However, the flat longitudinal shape of the tip creates a constantly shifting point of contact between the bi-metal and the calibration screw as the screw is adjusted. This creates an uneven calibration adjustment whereby the amount of bi-metal 36 adjustment is not consistent throughout the full 360° of screw rotation. Additionally, the calibration screw taught in U.S. Pat. No. 4,513,268 can only be installed in a single direction because the nut cannot receive the head of the screw and a screwdriver cannot be effectively applied to the tip. This unidirectional screw is particularly troublesome where automated assembly or other high speed manufacturing is used because proper screw orientation is limited to single position. The method of sealing the screw in place is also not optimal. The sealant will only reach the screw head and the threads nearest the head that it is forced into. This creates a seal that can be more easily broken due to shock or vibration when compared with improved methods. The breaker calibration setting may also unintentionally shift at this time.

Thus, there is a particular need for a calibration screw that provides a consistent calibration adjustment and is not limited to a single orientation. A calibration screw with improved features would reduce manufacturing defects, increase manufacturing speed and improve the calibration adjustment of molded case breakers. Further advantages could be gained by an improved method of sealing the calibration screw in place following completion of the calibration.

SUMMARY OF THE INVENTION

According to the present invention, the foregoing and other objects and advantages are attained by a calibration screw that includes a cylindrical body, a first end and a second end. The first end and the second end having common features including a convex tip surface. The cylindrical body is shaped to allow sealant to flow below the screw head when the calibration screw is in installed in a circuit breaker. A calibration method that permanently seals the calibration screw in place following adjustment is also included in the present invention.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of instrumentalities and combinations particularly pointed out in the appended claims.

DESCRIPTION OF THE PREFERRED EMBODIMENT OF THE INVENTION

Figure 1:
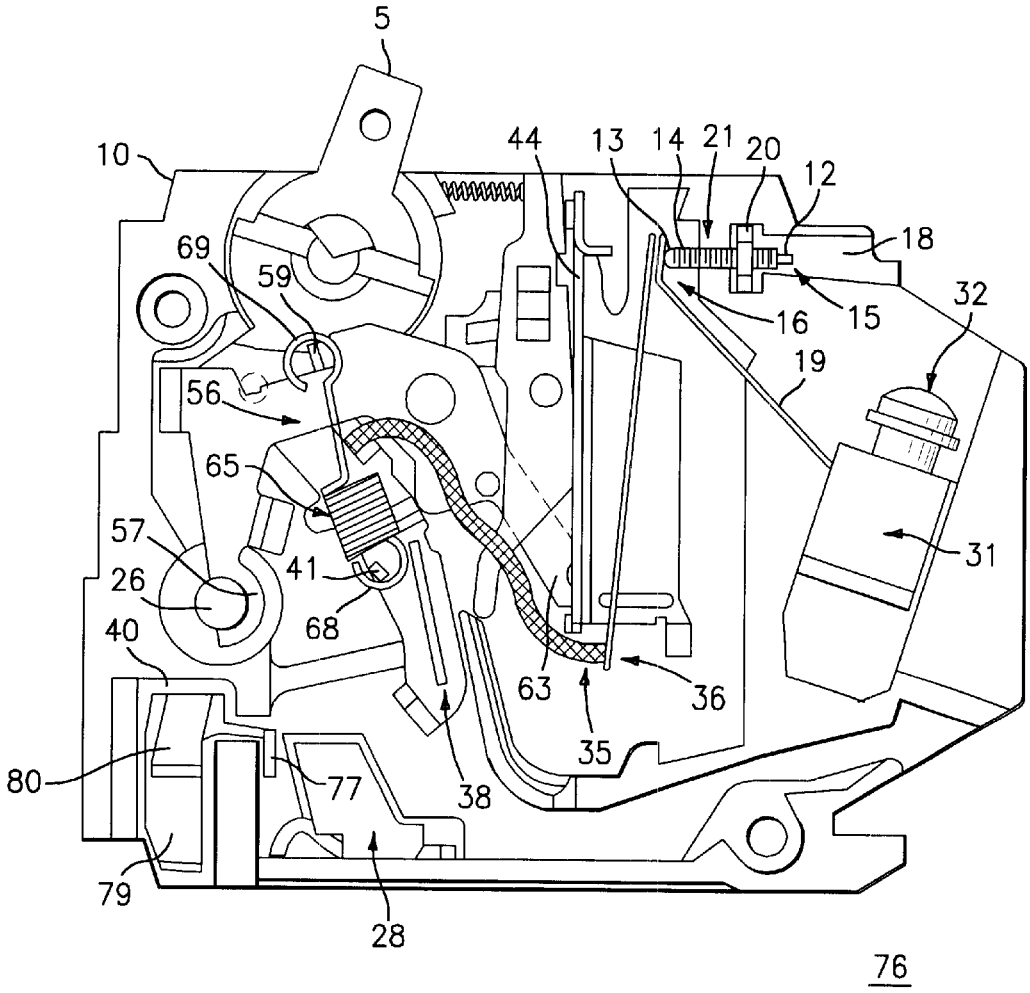
FIG. 1 is a plan view of an assembled molded case circuit breaker embodying the invention with the cover removed.

Referring to FIG. 1, a circuit breaker 76 employing an improved calibration screw 21 in accordance with the invention is depicted. FIG. 1 depicts a molded case circuit breaker 76, but the invention can be applied to other circuit breakers employing a calibration screw such as insulated case circuit breakers, metal frame circuit breakers and the like. The circuit breaker 76, shown in the open position, includes a molded, electrically insulating case 10. The circuit breaker 76 is connected to external electrical circuits by means of a line stab 79 and a terminal lug 31. In operation, current flows from the line stab 79 to the terminal lug 31 across contacts 40, 77 when the circuit breaker 76 is closed. The current path comprises the line stab 79, a stationary contact 77 attached to the inner end of the line stab 79, a moveable contact 40 located at the distal end of a contact blade 38, an inner conductor 35 joining the contact blade 38 to the inner end of a bi-metal 36 and an outer conductor 19 joining the outer end of the bi-metal 36 to a terminal lug 31. The inner conductor 35 is shown in a preferred embodiment, FIG. 1, in the form of a flexible braided conductor. However, it will be appreciated by persons skilled in the art that a variety of conductor configurations such as strap, bus or rod and the like may also be used depending upon the circuit breaker configuration. It will also be appreciated that other conductor configurations such as braid, bus or rod and the like may also be used for the outer conductor 19. The outer conductor 19 is shown as a conductive strap in FIG. 1.

The contact blade 38 cooperates with a cradle 56, the handle 5, and mechanism spring 65 to move between an opened and closed position. The cradle 56 has an overall inverted U shape and includes a semicircular end member 57 and a latch 63. The semicircular end member 57 engages a cradle pivot 26 and restricts the cradle to a pivoting motion around the cradle pivot 26. The proximate end of the contact blade 38 includes a pivot end tab (not shown) that engages the operating handle 5. The mechanism spring 65 is attached between the cradle 56 and the contact blade 38 by hooking a first spring eye 69 over cradle tab 59 and a second spring eye 68 over the contact blade tab 41. The spring provides the energy for the snap action that acts to rapidly open or close the circuit breaker contacts 40, 77.

The distal end of the contact blade 38 is driven away from the handle toward the stationary contact 77 when the handle 5 is moved from the open to the closed position. The motion of the contact blade 38 is translated to the cradle 56 by the mechanism spring 65 and acts to rotate the cradle 56 in a clockwise direction. The pivoting motion is stopped when the latch 63 is engaged by a latch opening (not shown) formed in the inner end of the armature 44. The mechanism spring 65 is stretched to a maximum operational length as the distal end of the contact blade 38 continues to travel away from the handle 5 until the contact blade 38 travels through the line of action of mechanism spring 65 and the resultant toggle action closes the contacts 40, 77. The circuit breaker 76 remains in the closed position until the user returns handle 5 to the open position or an overcurrent condition occurs.

A bi-metal 36 provides the circuit breaker low overcurrent protection. The bi-metal 36 is designed to heat up and deflect when the breaker 76 is carrying an overcurrent. The bi-metal 36 is arranged between a magnet assembly 43 and an armature 44. In the apparatus of FIG. 1 the present invention is embodied in the calibration screw 21. The calibration screw 21 engages the outer end of the bi-metal 36 and is used to adjust the low overcurrent trip setpoint. The depth of penetration of the calibration screw 21 establishes the bi-metal 36 pivot point located at the outer end of the bi-metal. The penetration depth and pivot point adjustment also establish the circuit breaker 76 calibration. The greater the penetration of the calibration screw 21 in the threaded receptacle 20 the more the bi-metal pivot point is shifted and the lower the current level at which the circuit breaker 76 will trip. The design depicted in FIG. 1 includes an armature 44 having an armature tab (not shown). During an overcurrent, the inner end of the bi-metal 36 deflects in the direction of the terminal lug 31 and engages the armature tab. The circuit breaker opens when the bi-metal deflection 36 is great enough that the armature 44 movement unlatches the cradle latch 63 from latch opening. The mechanism spring 65 pivots the cradle in a clockwise direction around the cradle pivot 26 as seen in FIG. 1 when the cradle 56 is unlatched. As the cradle 56 pivots, the line of action of the spring 46 passes the pivot point of the contact blade 38 with the result that the toggle action snaps the contact blade 38 about its pivot in a counterclockwise direction to open the contacts 40, 77. The armature and magnet design shown in FIG. 1 differ from the design shown in U.S. Pat. No. 3,464,040 and U.S. Pat. No. 4,513,268 at least in that the bi-metal engages the armature 44 directly and does not engage the magnet 43 in order to trip the circuit breaker 76.

Figure 2:
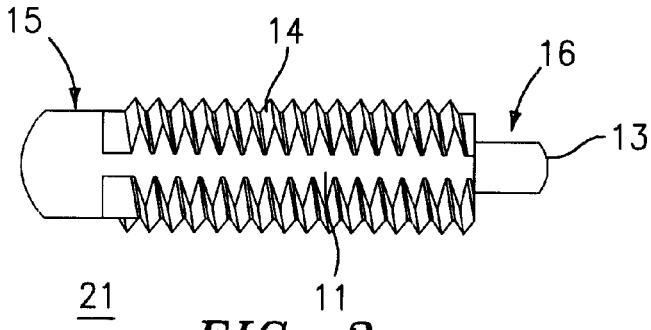
FIG. 2 is a plan view of a calibration screw in accordance with invention.

The calibration screw 21 details are shown in FIG. 2. The screw 21 is double headed and includes a first end 15 and a second end 16 and a threaded cylindrical body 14. The ends 15, 16 include similar shaped tip surfaces 13. In a preferred embodiment the tip surface 13 is sufficiently convex to provide a single point of contact throughout 360° of calibration 21 screw rotation. The calibration screw 21 preferably has a tip surface 13, formed at the first and second ends 15, 16, with a spherical radius between 0.020 and 0.080 inches. A spherical radius between 0.040 and 0.075 is more preferred. The spherical radius is most preferably about 0.060 inches. The most preferred radius will vary within the range of manufacturing tolerance of approximately 0.005 inches. Those skilled in the art will recognize that the spherical radius can be increased and decreased within a wider range of values so long as the tip surface provides a single point of contact with the bimetal 36 throughout the full 360° rotation of the calibration screw 21.

Each end 15, 16 also includes a screw driver engagement surface 12. FIG. 2 shows a screwdriver engagement surface 12 having parallel walls. However, it will be recognized that screwdriver engagement surface 12 may be embodied in a variety of configurations such as T, X or hex shaped or the like for use with different style screwdrivers. FIG. 2 also shows that the screw driver engagement surface 12 is offset at the first end 15 when referenced to the second end 16 of the screw 21. The threading and diameter of the body 14 are designed to provide threaded engagement of the calibration screw 21 with the threaded receptacle 20 through which it penetrates. A preferred embodiment shown in FIG. 1 shows the threaded receptacle 20 in the form of a nut that is preassembled with the calibration screw 21 before the subassembly is placed in the insulated case 10 during assembly. However, it will be recognized by one skilled in the art that the threaded receptacle 20 may be embodied in a variety of structures such as a threaded receptacle formed in the molded case 10 or the outer conductor 19.

A particular advantage provided by the structure of the calibration screw 21 embodied in the present invention is that the screw 21 is double head and can be driven from either the first end 15 or second end 16. Additionally, the tip surface 13 located at either end 15, 16 is suitable for engagement with the bi-metal 36. The tip surface 13 provides a smooth, consistent adjustment and a single point of contact throughout the adjustment of the screw 21. The double headed construction speeds circuit breaker assembly because the screw 21 can be inserted in the threaded receptacle from either end. Manufacturing defects are reduced because the screw 21 is properly oriented regardless of which screw end is inserted into the threaded opening 20. The tip surface 13 provides additional quality improvements because each degree of screw rotation provides the same amount of bi-metal 36 deflection.

Thus, the calibration adjustment is made in a continuous manner whereby every degree of calibration screw 21 rotation provides the same amount of bi-metal 36 deflection. This provides a more uniform and precise circuit breaker calibration. In a preferred embodiment the two ends of the calibration screw are identical. The two ends may also be offset from one another.

Figure 3:
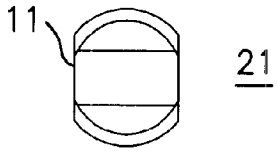
FIG. 3 is a plan view of one end of the calibration screw in FIG. 2
Figure 4:
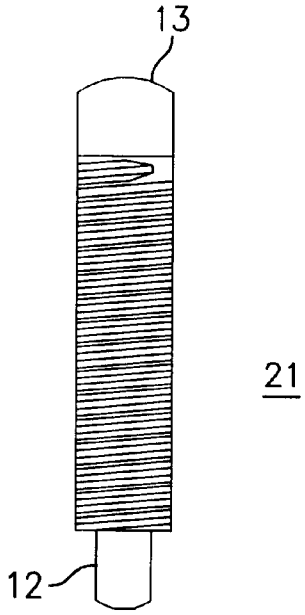
FIG. 4 is a plan view of the calibration screw in FIG. 2 rotated ninety degrees around a lengthwise axis.

The threaded cylindrical body 14 may also include at least one planar surface 11. FIG. 2 and FIG. 3 show the calibration screw 21 in an orientation that highlights this feature. The planar surface 11 allows for an improved method of permanently fixing the circuit breaker calibration 76. A cavity is formed between the planar surface 11 and the walls of the threaded receptacle 20 when the calibration screw 21 is installed. The cavity is accessible from the exterior of the circuit breaker 76 and allows for the penetration of sealant 18 into the cavity following calibration. This method provides an improved means of fixing the calibration setting by wedging the screw 21 in place. The planar surface 11 is shown on opposite sides of the calibration screw 21 running the entire length of the screw 21 between the ends 15, 16.

However, a person skilled in the art will recognize that the quantity, width and length of planar surface 11 is not restricted to the configuration shown in the drawings. The size of the planar surface may be varied so long as a high enough percentage of the cylindrical body 14 remains threaded to facilitate proper installation, and so long as the cavity created by the planar surface 11 provides enough space for the amount of sealant 18 necessary to provide the desired holding power. For example, the epoxy will fail to fix the calibration screw position if the recess provided by the planar surface 11 of the installed calibration screw 21 is too small. Conversely, a large planar surface 11 may provide a threaded surface too small to properly install and adjust the calibration screw 21. The advantages of a double headed screw are best utilized where at least one planar surface 11 is accessible from either end 15, 16 of the screw 21.

The calibration screw 21 can be manufactured from metals, preferably castable metals that have mechanical properties similar to steel. The mechanical properties should closely approximate the properties of carbon steel for hardness, strength and durability. Standard screw manufacturing techniques such as machining, casting and the like may be used to produce the calibration screw 21. Screw production is not limited to these forms of manufacture and persons skilled in the art will recognize alternatives. However, a particular advantage of the invention is realized when the screw 21 is manufactured by a casting process. The bond formed between adjacent cast screws during manufacture is generally broken along a parting line. Therefore the planar surface 11 is automatically created along the parting line when the cast screws are separated. In a preferred embodiment the screw is cast from a zinc alloy comprised of greater than 90% zinc with the balance consisting of a mixture of copper, aluminum, magnesium, iron and tin. In a preferred embodiment the calibration screw is dipped in a yellow chromate bath to provide corrosion protection.

The preceding features allow for an improved method of calibrating circuit breaker thermal overcurrent protection. A double headed calibration screw 21 including ends 15, 16 having identical convex tip surfaces 13 and at least one planar surface 11 as shown in FIG. 2 is inserted into the threaded receptacle 20. The circuit breaker 76 is then closed. The screw 21 is threaded into the receptacle 20 until a second end 16 engages the outer end of bi-metal 36. The screw 21 is threaded further into the receptacle 20 to deflect the bi-metal 36 and adjust the circuit breaker calibration. One calibration method includes the step of threading the screw 21 into the threaded opening 20 until the circuit breaker 76 opens. The direction of screw 21 rotation is then reversed for a predetermined number of degrees to finalize the calibration screw 21 setting. The screw driver is disengaged and sealant 18 is injected into the cavity formed between the planar surface 11 and the threaded receptacle 20. The calibration setting is fixed and the calibration screw 21 locked in place when the sealant 18 cures.

Figure 5:
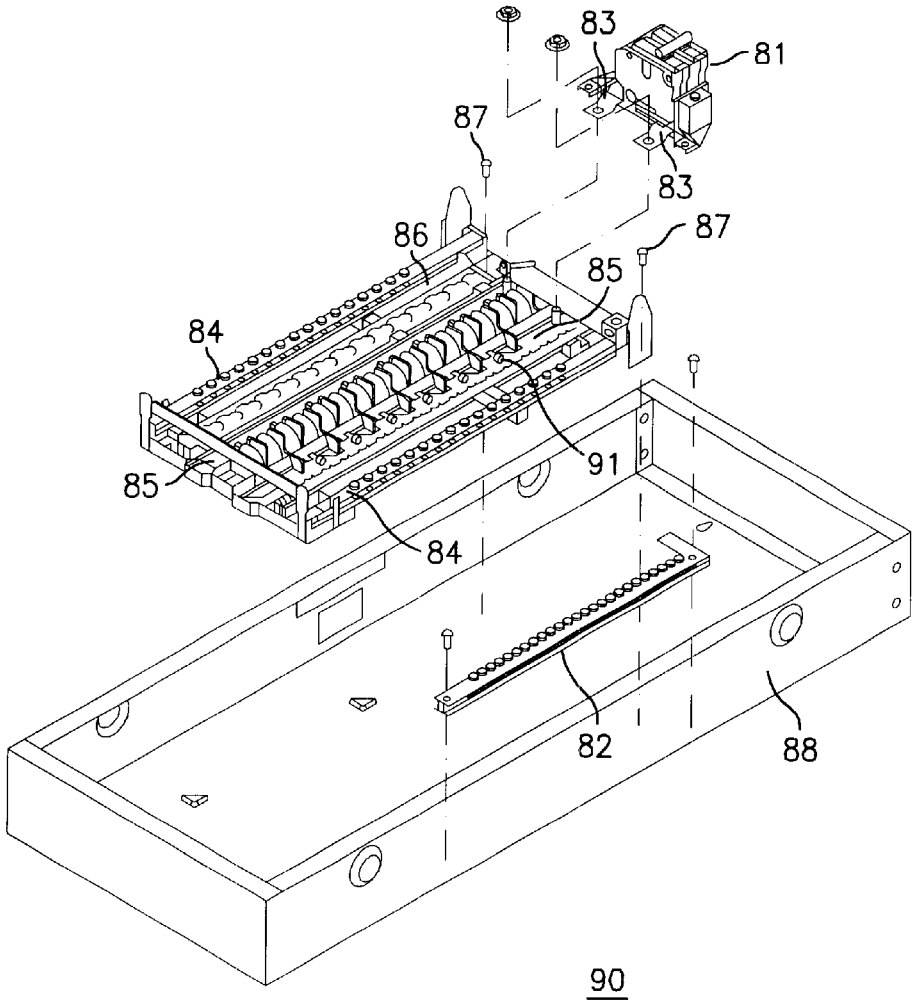
FIG. 5 is an isometric front view of a load center that includes a molded case circuit breaker embodying the invention.

FIG. 5 shows a loadcenter 90 that includes a two pole main breaker 81 that embodies the aforementioned calibration screw 21. The saddle 86 includes the power busses 85 and neutral busses 84, and is secured to the rear shell 88 of loadcenter 90 by a plurality of mounting screws 87. The loadcenter 90 also includes a ground bus 82. The main breaker 81 is connected to the power busses 85 via conducting flanges 83. The saddle 86 includes a plurality of breaker positions 91 where individual distribution circuit breakers (not shown) embodying the invention are connected to the power busses 85. The circuit breaker 76 shown in FIG. 1 is typical of a distribution circuit breaker used with loadcenter 90. The distribution circuit breakers line stab 79, in FIG. 1 slideably engages the power bus 85 to connect the circuit breaker 76 to the power source. The loadcenter 90 is typically mounted vertically with the main breaker 81 located at the top of the loadcenter 90. A front panel (not shown) is secured to the face of the loadcenter 90 to prevent inadvertent exposure to energized parts. Generally, the front panel includes a door that allows access to the circuit breakers mounted in the loadcenter 90.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A double headed circuit breaker calibration screw comprising:

a threaded cylindrical body;

a first end and a second end located at opposite ends of said threaded cylindrical body, wherein;

said first end and said second end have similar shapes; and further wherein said first and second ends each include tool engagements surfaces.

2. The double headed circuit breaker calibration screw as claimed in claim 1, wherein said first end and said second end each include a screwdriver engagement surface.

3. The double headed circuit breaker calibration screw as claimed in claim 2, wherein said first end and said second end each include a convex tip surface.

4. The double headed circuit breaker calibration screw as claimed in claim 3, wherein the screw is manufactured by a casting process.

5. The double headed circuit breaker calibration screw as claimed in claim 3, wherein said threaded cylindrical body includes at least one planar surface.

6. The double headed circuit breaker calibration screw as claimed in claim 3, wherein said convex tip is a spherical radius formed at each of said first end and said second end.

7. The double headed circuit breaker calibration screw as claimed in claim 6, wherein;

one of said convex tips provides a single point of contact with a bi-metal throughout 360 degrees of screw rotation.

8. The double headed circuit breaker calibration screw as claimed in claim 7, wherein said spherical radius formed at said convex tip is about 0.060 inches.

9. The double headed circuit breaker calibration screw as claimed in claim 2, wherein said screwdriver engagement surface of said first end is offset from said screw driver engagement surface of said second end.

10. A circuit breaker comprising:

a molded plastic case;

a line stab and a terminal lug arranged within said molded plastic case to connect said circuit breaker to an external electrical power source and an external electrical load;

a current path between said line stab and said terminal lug, wherein electrical continuity exists between the line stab and the terminal lug with said circuit breaker in a closed position; and a double headed calibration screw threaded into a threaded receptacle, wherein said calibration screw includes a threaded cylindrical body, a first end accessible from outside said molded plastic case and a second end located opposite said first end, wherein said first end and said second end have similar shapes, and further wherein said first and second ends each include tool engagement surfaces.

11. The circuit breaker as claimed in claim 10, wherein a convex tip surface is located at said first end and said second end of said double headed calibration screw.

12. The circuit breaker as claimed in claim 11, wherein said first end and said second end of said double headed calibration screw each include a screw driver engagement surface.

13. The circuit breaker as claimed in claim 12, wherein said cylindrical threaded body includes at least one planar surface.

14. The circuit breaker as claimed in claim 13, wherein said planar surface extends uninterrupted between said first end and said second end.

15. The circuit breaker as claimed in claim 11, wherein the convex tip of said double headed calibration screw is a spherical radius formed at said convex tip and said convex tip provides a single point of contact with a bi-metal throughout 360 degrees of screw rotation.

16. The circuit breaker as claimed in claim 15, wherein said spherical radius formed at said convex tip is between about 0.020 and 0.080 inches.

* * * * *